US006209974B1

(12) United States Patent
Goto et al.

(10) Patent No.: US 6,209,974 B1
(45) Date of Patent: Apr. 3, 2001

(54) WIRE DRESS PROTECTOR FOR A TELEVISION CABINET STAND

(75) Inventors: Hirokazu Goto, San Diego; Shunsuke Hanaoka, Poway; Jared Lee Zamaloff, San Diego, all of CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/190,384

(22) Filed: Nov. 10, 1998

(51) Int. Cl.[7] ..... A47B 5/00
(52) U.S. Cl. ..... 312/7.2; 348/346.01; 312/223.6
(58) Field of Search ..... 312/7.2, 223.6; D34/12; 248/917, 9.8, 346.01; 348/843, 836

(56) References Cited

U.S. PATENT DOCUMENTS 4,245,871 * 1/1981 Rex ..... 312/7.2

FOREIGN PATENT DOCUMENTS

2911915 * 11/1980 (DE) ..... 312/7.2

* cited by examiner

*Primary Examiner*—Peter M. Cuomo
*Assistant Examiner*—Jerry Anderson
(74) *Attorney, Agent, or Firm*—Blakely, Sokoloff, Taylor & Zafman LLP

(57) ABSTRACT

The invention relates to a back column for controlling and guiding the cabling of an entertainment center. The back column has a panel having two wings and a face board attached to the two wings. Each wing extends the panel first in an angular direction towards the entertainment center then extends the panel parallel to the entertainment center. The back column has cutouts through which cabling may pass. Other features are disclosed.

10 Claims, 4 Drawing Sheets

WIRE DRESS PROTECTOR FOR A TELEVISION CABINET STAND

BACKGROUND OF THE INVENTION

1. Field of the Invention

The present invention relates generally to television cabinet stands, and more particularly to a wire dress protector for a television cabinet stand.

2. Prior Art

Conventional digital television (DTV) stands typically have a boxed shaped construction comprising four walls, perpendicularly adjacent to one another. Where the stand also serves as a cabinet, the cabinet has doors that are locked to the cabinet by magnets. The doors to the cabinet are then opened by pushing in on the door to unlock the magnet lock and then pivoting the doors out and away from the cabinet.

Within television cabinets, the owners of televisions store a variety of auxiliary electronic equipment that supports the features of the television. For example, a video cassette recorder (VCRs) permits the owner to play prerecorded shows on their television from the VCRs. To couple the VCR to the television, wires or cables are run from the VCR to the television. In addition, power cords, cable TV cords, and the like are run to and from the television. This multitude of wiring forms an uncontrolled "dress" of wires that pose a danger to a small child, for example, should the small child get close to the wires, or to the auxiliary electronic equipment, for example, should current unexpectedly pass from the wires to the equipment. Moreover, should the television stand be pushed too close to the room wall, the unprotected wires of the wire dress may be crimped or even crushed so as to interfere with the performance of the television unit.

Thus, in a television cabinet stand, there is a need for a back column for the wires and bumpers to maintain the stand a distance away from the wall.

BRIEF SUMMARY OF THE INVENTION

The invention relates to a back column for controlling and guiding the cabling of an entertainment center. The back column has a panel having two wings and a face board attached to the two wings. Each wing extends the panel first in an angular direction towards the entertainment center then extends the panel parallel to the entertainment center. The back column has cutouts through which cabling may pass. Other features are disclosed.

DETAILED DESCRIPTION OF THE INVENTION

For purposes of explanation, specific embodiments are set forth to provide a thorough understanding of the present invention. However, it will be understood by one skilled in the art, from reading this disclosure, that the invention may be practiced without these details. Moreover, well-known elements, devices, process steps and the like are not set forth in detail in order to avoid obscuring the present invention.

Figure 1:
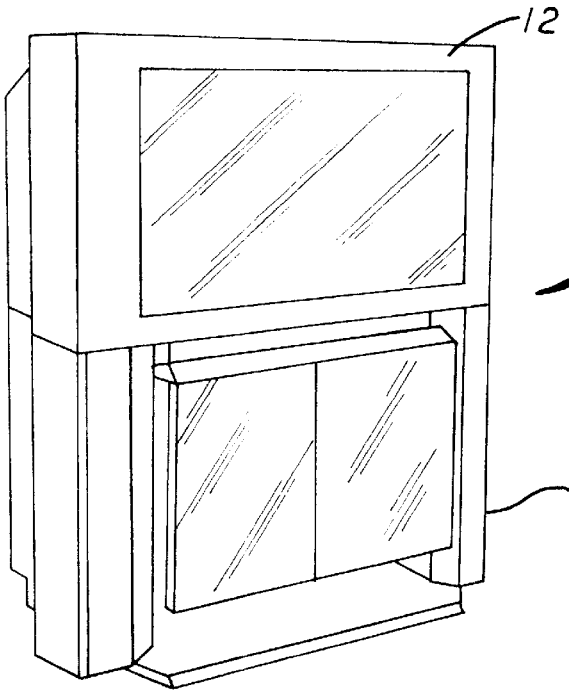
FIG. 1 is an isometric view of an embodiment of the present invention.

Reference is now made to FIGS. 1 through 4 to illustrate the embodiments of the invention. FIG. 1 is an isometric view of an embodiment of the present invention. Entertainment center 10 comprises television 12 being supported by cabinet stand 14. Television 12 may be a digital television. The support includes a place on which to locate television 12 and a place in which to locate auxiliary service devices that enhance the features of television 12. Such devices may include video cassette recorders and sound enhancing devices.

Figure 2:
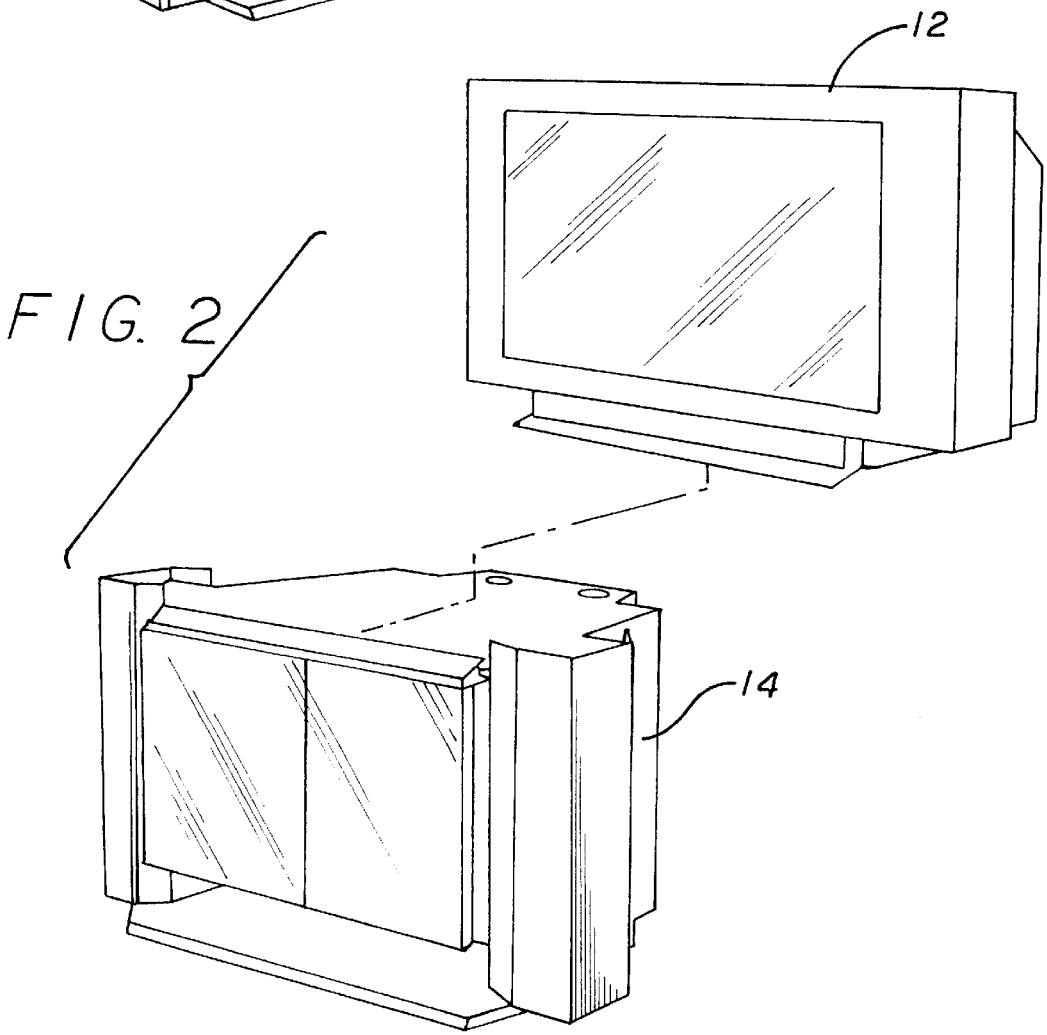
FIG. 2 is an exploded view of an entertainment center showing a digital television removed from a cabinet stand.
Figure 3:
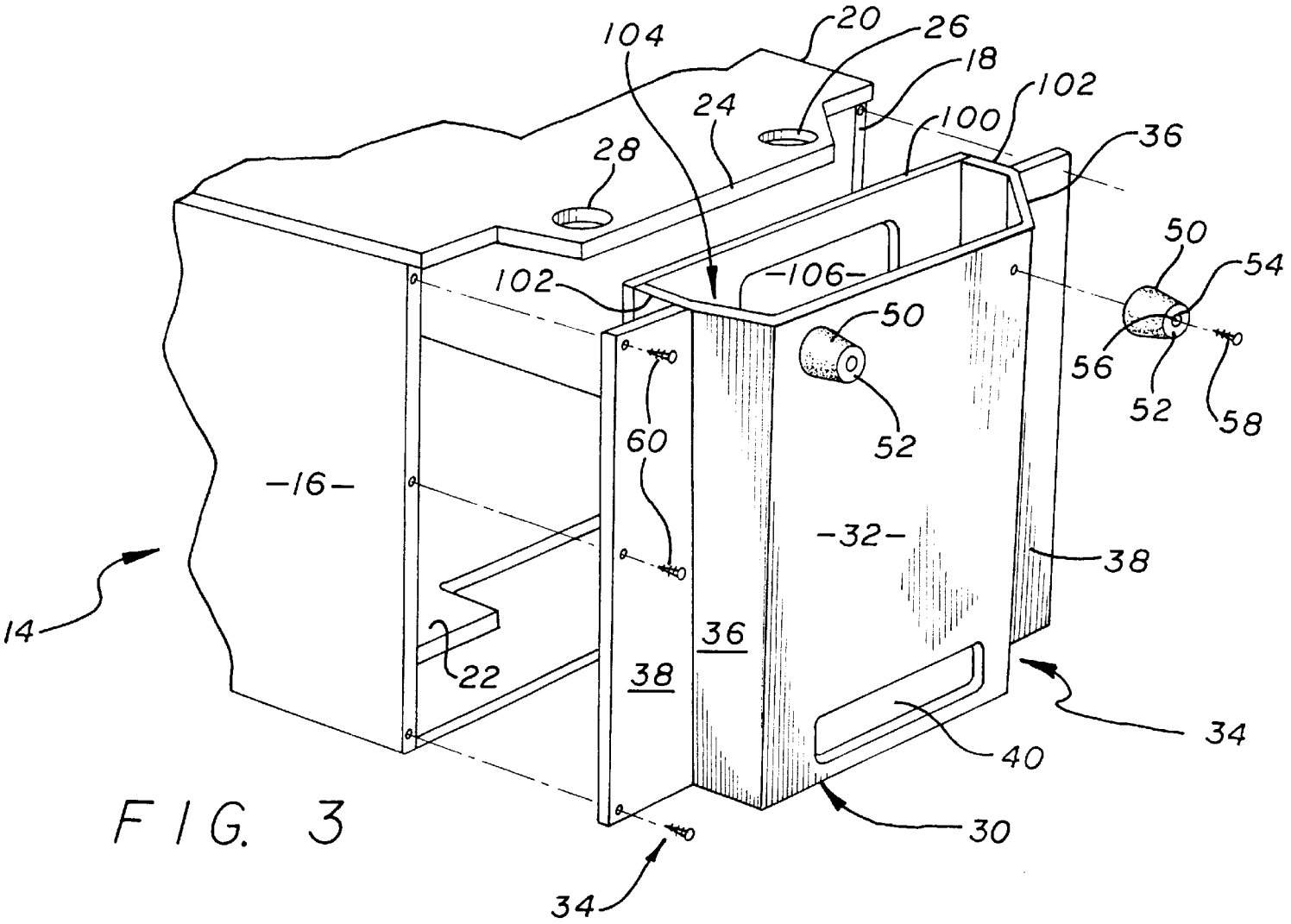
FIG. 3 is an exploded view of an embodiment of the invention.

FIG. 2 is an exploded view of entertainment center 10 showing television 12 removed from cabinet stand 14. FIG. 3 is an exploded view of an embodiment of the invention. Cabinet stand 14 comprises, in part, first side panel 16, second side panel 18, top board 20, and bottom board 22. Top board 20 preferably is shaped to the bottom footprint (or profile) of television 12. Top board 20 and bottom board 22 are coupled between first side panel 16 and second side panel 18 to form an opening in the rear of cabinet stand 14. Top board 20 further has trapezoid flange 24 with first hole 26 and second hole 28 that permit wires to be passed through flange 22 of top board 20. Since top board 20 preferably is shaped to the bottom profile of television 12, trapezoid flange 24 importantly serves to extend top board 20 away from the bottom profile of television 12 to ensure that first hole 26 and second hole 28 are clear of interference from the bottom profile of television 12.

To control the dress of the wires that run between the auxiliary service devices, television 12, and external auxiliary service such as a power source or signal wire as well as to keep the wires from touching a wall of the room, back column 30 may be provided. To preferably form fit with the profile displayed by the opening in the rear of cabinet stand 14, back column 30 may have panel 32 from which wings 34 extend. Each wing 34 has angled extension 36 that extends panel 32 at the obtuse angle of the trapezoid flange 24 and has parallel extension 38 that extends panel 32 to first side panel 16 and second side panel 18. Preferably, back column 30 extends to the height of first side panel 16 and second side panel 18. To run power to the auxiliary service devices within cabinet stand 14, back column 30 may have material removed to define rectangular cutout 40. To control the wire dress from interfering with the auxiliary service devices within cabinet stand 14, face board 100 is attached to angled extensions 36 by members 102 as shown, to form hollow column 104. Access cutouts are provided in face board 100 to provide access to hollow column 104 from within cabinet stand 14 as disucssed in connection with FIG. 4.

To further keep the wires from touching a wall of the room as well as prevent crimping or crushing the wires of entertainment center 10, bumpers 50 may be provided. Preferably made of a soft material, bumper 50 may be a conic shape having the crown of the cone removed to form flat surface 52. Preferably, flat surface 52 is located at a distance of one inch from the surface of panel 32. This distance permits bumpers 50 to engage the wall of the room without crimping or crushing the wires of entertainment center 10. To fasten each bumper 50 to back column 30, bumper 50 is formed with recess 54 having through hole 56 into which screw 58 is inserted and tightened into the material of back column 30. To attach back column 30 to cabinet stand 14, a plurality of screws 60 may be tightened through back column 30 and into first side panel 16 and second side panel 18.

Figure 4:
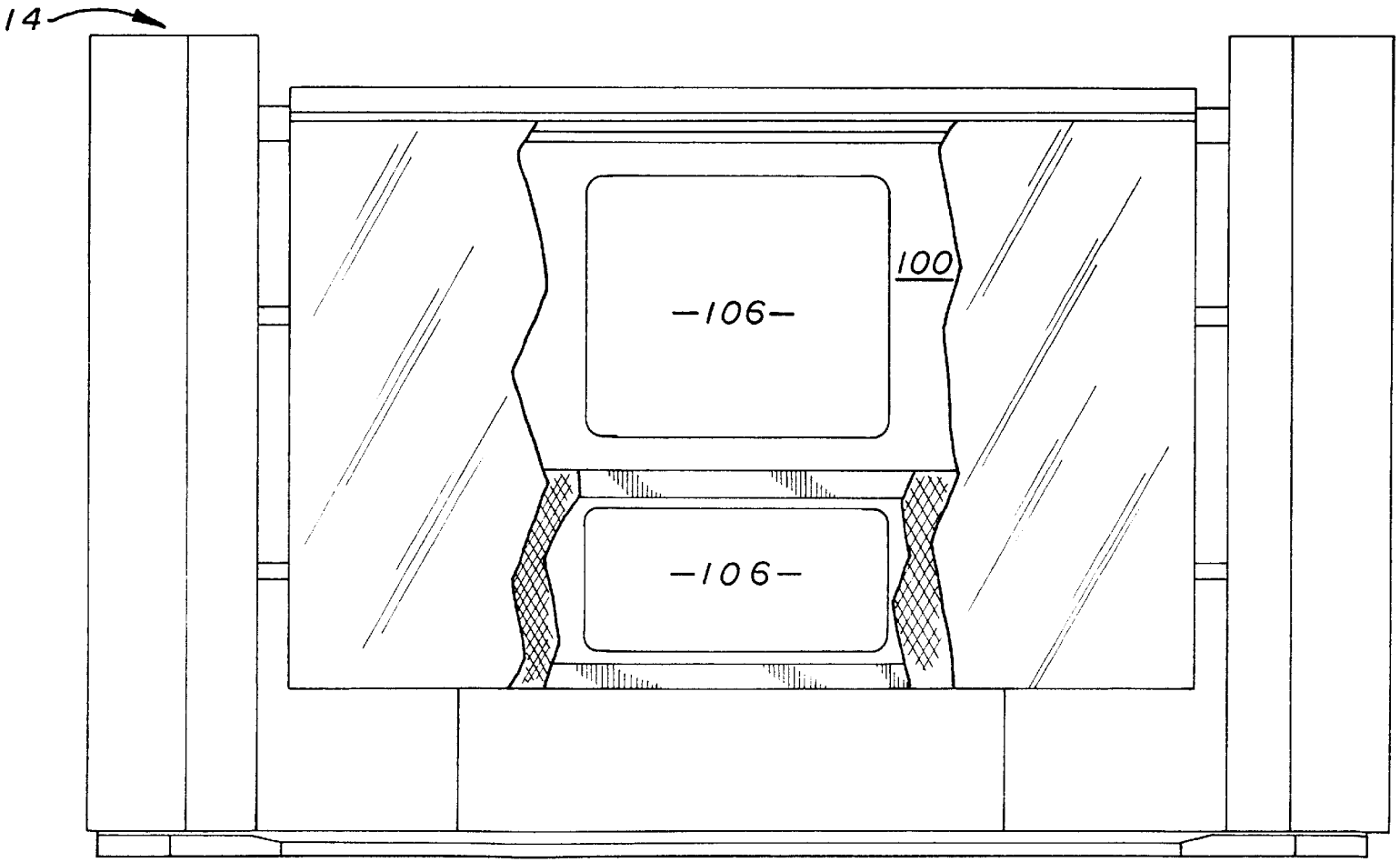
FIG. 4 is a front view with the doors partially removed to reveal the access cutouts in the face board of the back column.

FIG. 4 is a front view with the doors partially removed to reveal access cutouts 106 in face board 100 of back column 30. Access cutouts 106 are provided in face board 100 to provide access to hollow column 104 from within cabinet stand 14 so as to permit the user to run wires within hollow column 104 from within cabinet stand 14. Preferably there are two access cutouts 106.

Figure 5:
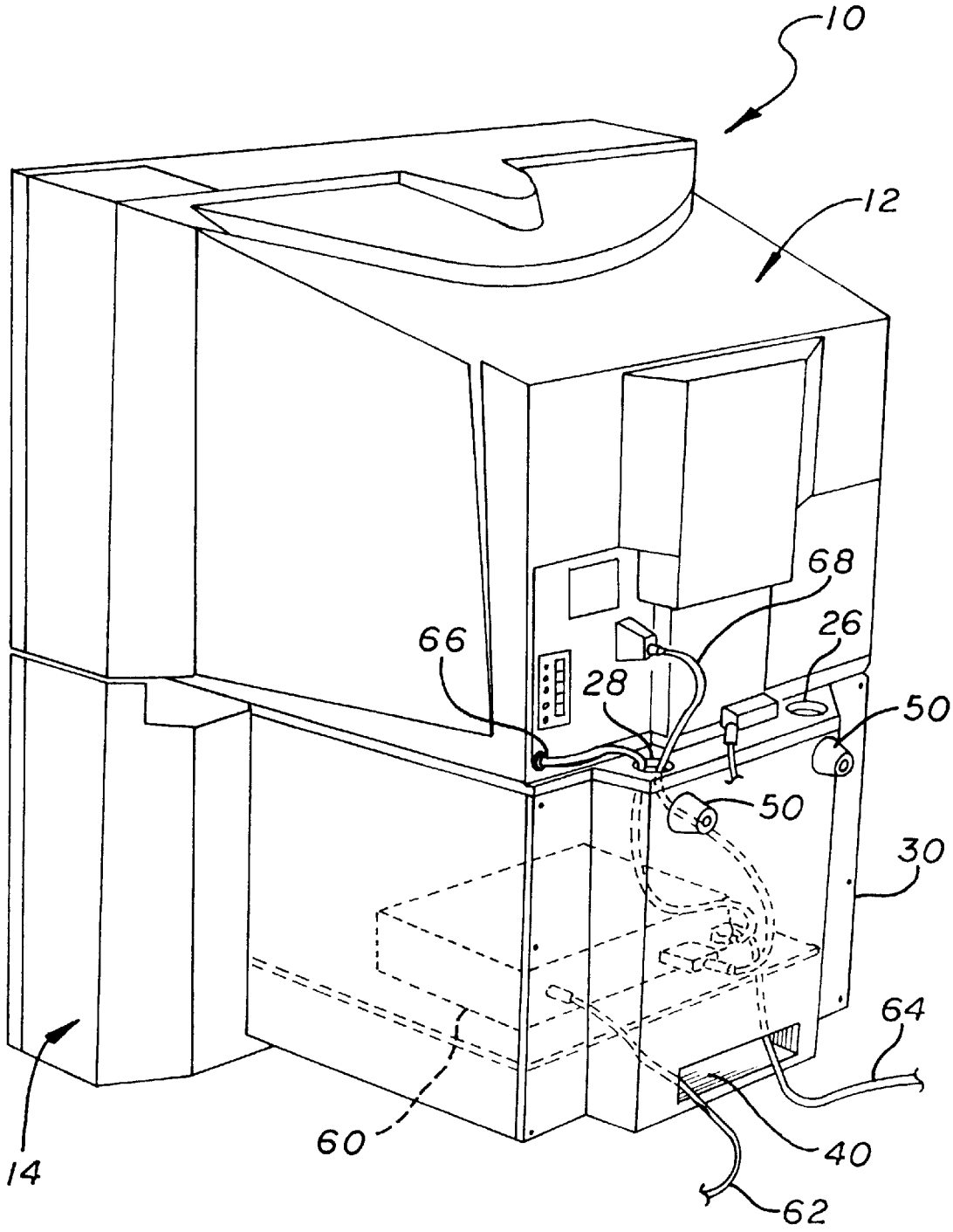
FIG. 5 is a rear assembly view of the entertainment center.

FIG. 5 is a rear assembly view of entertainment center 10. Shown in phantom is VCR 60. Power cord 62 and signal wire 64 are threaded through rectangular cutout of 40 of back column 30 to engage VCR 60. From VCR 60, power is supplied to digital television by running power cord 66 from VCR 60 to television 12 through second hole 28. Also from VCR 60, signal is supplied to digital television by running signal wire 68 from VCR 60 to television 12 through second hole 28.

While the present invention has been particularly described with reference to the various Figures, it should be understood that the Figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. In a television cabinet stand for a television having a bottom profile, the television cabinet stand having a back column, a first side panel, a second side panel, a top board having a trapezoid flange, the trapezoid flange at a back edge having at least one hole and defining two equal obtuse angles, and a bottom board, the top board and the bottom board coupled between the first side panel and the second side panel to form an open profile, the back column coupled to the open profile to cover a rear opening of the stand and comprising:

a panel having a cutout, having a first wing, and having a second wing, the first wing having a first angled extension and a first parallel extension, wherein the first angled extension projects towards the open profile at an angle that is equal to the obtuse angles of the trapezoid flange and wherein the first parallel extension is coupled to the first angled extension at a first end and extends to the first side panel in a direction that is parallel to the panel, the second wing having a second angled extension and a second parallel extension, wherein the second angled extension projects towards the open profile at an angle that is equal to the obtuse angles of the trapezoid flange and wherein the second parallel extension is coupled to the panel at a first end and extends to the second side panel in a direction that is parallel to the panel; and a face board attached to the first angled extension by a first member and attached to the second angled extension by a second member, the face board having a plurality of access cutouts wherein a hollow column for wiring is defined by the face board, angled extensions, the first and second members and the panel, the hollow column covered by the trapezoid flange when the back column is coupled to the profile opening.

2. The back column of claim 1, the panel, first side panel, and the second side panel each having a height, wherein the height of the panel extends the height of first side panel and the height of the second side panel, further comprising:

at least one bumper attached to the back column.

3. The back column of claim 2 wherein the plurality of access cutouts in the face board are two access cutouts.

4. The back column of claim 3 wherein the cutout is rectangular shaped.

5. The back column of claim 1 wherein the at least one bumper is two bumpers.

6. The back column of claim 5 wherein each bumper is conic shape, the conic shape having a crown removed to form a flat surface.

7. The back column of claim 6 wherein each bumper is one inch in length.

8. The back column of claim 7, each bumper has a hole, wherein each bumper is attached to the back column with a screw.

9. The back column of claim 8, each bumper hole having a diameter, each bumper further having a recessed portion having a diameter that is greater than the diameter of the hole.

10. The back column of claim 9 wherein the back column is attached to the first side panel and the second side panel with a plurality of screws.

* * * * *